US006672950B2

(12) United States Patent
Peng et al.

(10) Patent No.: US 6,672,950 B2
(45) Date of Patent: Jan. 6, 2004

(54) CONTAMINATION PREVENTION SYSTEM AND METHOD

(75) Inventors: Chih-I Peng, Hsin-Chu (TW); Wen-Ten Chen, Chung-Ho (TW); Yu-Chia Chang, Hsin-Chu (TW); Yao-Hsiang Liang, KaoHsiung (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 6 days.

(21) Appl. No.: 10/062,965

(22) Filed: Jan. 30, 2002

(65) Prior Publication Data

US 2003/0143937 A1 Jul. 31, 2003

(51) Int. Cl.[7] ..... B24B 55/04
(52) U.S. Cl. ..... 451/451; 451/444
(58) Field of Search ..... 451/444, 445, 451/448, 451, 452, 454, 41, 285, 286, 287

(56) References Cited

U.S. PATENT DOCUMENTS 5,745,946 A * 5/1998 Thrasher et al. ..... 15/77
6,206,760 B1 * 3/2001 Chang et al. ..... 451/41

* cited by examiner

*Primary Examiner*—Dung Van Nguyen
(74) *Attorney, Agent, or Firm*—Tung & Associates

(57) ABSTRACT

The present invention discloses a contamination prevention system and method of use having a contamination prevention shield that cooperates with a high pressure rinse apparatus to prevent contamination of particles within a CMP apparatus. The contamination prevention shield has a cleaning cup, two vertical side shields, a front vertical shield, and a floor that cooperate to prevent leakage of fluid splattered during a high pressure rinse of the CMP apparatus and an interior portion of a CMP apparatus housing; and a high pressure rinse apparatus connected to the contamination prevention shield having a conduit with at least one nozzle for dispensing cleaning fluid during a high pressure rinse cycle. Additionally, a plurality of contamination prevention shields may be used in combination with the high pressure rinse apparatus to further prevent contamination of an interior portion of the housing and the CMP apparatus.

19 Claims, 11 Drawing Sheets

CONTAMINATION PREVENTION SYSTEM AND METHOD

FIELD OF THE INVENTION

The present invention generally relates to an apparatus and method for preventing particle contamination in a polishing machine that utilizes slurry for material removal and more particularly, relates to a method and apparatus for preventing particle contamination in a chemical mechanical polishing apparatus wherein a contamination prevention shield and a high pressure rinse apparatus cooperate to remove contaminated fluid from an interior region of the CMP housing.

BACKGROUND OF THE INVENTION

An apparatus for polishing thin, flat semi-conductor wafers is well-known in the art. Such an apparatus normally includes a polishing head that carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the ware and/or polishing head; a wafer unload station; or, a wafer load station.

More recently, a chemical-mechanical polishing (CMP) apparatus has been employed in combination with pneumatically actuated polishing head. The CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus as disclosed in U.S. Pat. No. 6,206,760 which is herein incorporated by reference is shown in FIG. 1A. The CMP apparatus 10 consists of a controlled mini-environmental 12 and a control panel section 14. In the controlled mini-environment 12, typically four spindles 16, 18, 20, 22 are provided (the fourth spindle 22 is not shown in FIG. 1A) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disk 30 rotated by a motor (not shown) in a direction opposite to the rotation al direction of the polishing head 26.

Also shown in FIG. 1A is a conditioner arm 32 which is equipped with a rotating conditioner disk 34. The conditioner arm 32 pivots on its base 36 for conditioning the polishing pad 38 for the in-situ conditioning of the pad during polishing. While three stations each equipped with a polishing pad 28, 38, 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results from a combination of chemical and mechanical effects is shown in FIG. 1C. The CMP method can be used to provide a planar surface on dielectric layers, on deep and shallow trenches that are filled with poly silicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a PH of 11 than with a slurry that has a pH of 7. The hardness of the polishing particles contained in the slurry composition should be about the same as the hardness of the film to be removed to avoid damaging the film. A slurry composition typically consists of an abrasive component, i.e., hard particles and components that chemically react with the surface of the substrate. For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e., larger than 500 nm/min. While ceria particles in the slurry composition remove silicon oxide at a higher rate than do silica, silica is still preferred because smoother surfaces can be produced. Other abrasive components, such as alumina ($Al_3O_2$) may also be used in the slurry composition.

A slurry composition is a material that easily accumulates after contacting dry air or without proper circulation of air. When slurry is left on the surface of the process environment, i.e., on the surface of the spindles or the conditioner arms in a CMP machine, it will dry a and accumulate to become a source of particle contamination for the wafers that are processed in the polishing housing interior. Slurry particles can easily fall from moving parts to the polishing pad due to mechanical vibration of the CMP apparatus to cause macro-scratch of the wafer surface. Slurry particles may also become source of particle contaminants for the wafer surface and for the CMP housing interior environment. It is therefore highly desirable that particle contaminants resulting from dry slurry to be avoided or eliminated.

Referring now to FIG. 1D, wherein a simplified plane view of a conventional CMP apparatus 50 is shown. In the apparatus 50, a CMP housing interior 52 houses a cross member 54 equipped with four spindles (not shown). Two spindle clean modules 56, 58 are positioned adjacent to the spindle positioned in the lower corner.

A plan view of a conventional CMP apparatus 50 is shown in FIG. 1E illustrating a conditioner arm 62. The conditioner disc 90 and conditioner arm 62 are cleaned by conventional methods to remove any slurry deposits splattered thereon during the chemical mechanical polishing process. Polishing pads 82, 84, and 86 are also shown in FIG. 1E without the spindle in place. It should be noted that for each of the polishing pad positions, e.g., for each of 82, 84, and 86, a conditioner arm 62 is utilized for the in-situ conditioning of the respective polishing pads.

A detailed perspective view of the conditioner arm 62 and the conditioner disc 90 resting in a conditioner clean cup 88 is shown in FIG. 2D. It is seen that slurry deposits 70 have cumulated on the top horizontal surface 92 of the conditioner disc 90. Conventional means for removing the slurry deposits from the conditoner disc include spraying deionized water from the bottom of the chamber.

FIG. 1G illustrates a conditioner arm shield used in the prior art. The housing wall has a portion that protrudes outwardly and allows the conditioner arm to rest therewithin. However, the conditioner arm shield of the prior fails to protect against a slurry accumulation on the inner walls of the housing and did not adequately prevent a slurry accumulation from accumulating on the conditioner arm pad.

The prior art allows for the slurry to splash on the skin cover during pad conditioning and during processing. The slurry also condenses on an inner portion of the housing wall 100 and becomes a solid small powder that often drops onto the pad. These slurry powder particles cause scratching of the wafer during processing and monitoring.

The deionized water also leaks between the inner surf ace of the middle skin and the CMP machine during a high pressure rinse. The middle skin of the prior art is made from a glass material that is very heavy and cracks or breaks easily. Also, access to the middle skin is difficult making it difficult to perform preventative maintenance on the skin or clean the inner wall.

The present invention provides a new stronger shield that avoids water leakage; and provides a water flow system adapted for use with the new shield to reduce slurry condensation on the CMP machine.

It is therefore an object of the present invention to provide a method for preventing particle contamination in a CMP apparatus that does not have the drawbacks or shortcomings of the conventional methods for preventing particle contamination in a CMP apparatus.

It is another object of the present invention to provide a method for preventing particle contamination in a CMP apparatus that utilizes a cleaning solvent to prevent the formation of particles from the slurry composition.

It is a further object of the present invention to provide a method for performing a high pressure rinse for preventing particle contamination in a CMP apparatus by providing a fluid conduit and a plurality of spray nozzles in the polishing CMP housing interior for the cleaning of dried slurry that was splattered on the machine surface and the interior wall of the CMP apparatus housing.

It is another further object of the present invention for preventing particle contamination of the interior housing wall of a housing for a CMP apparatus by providing a contamination prevention shield for directing flow of fluid from a high pressure rinse cycle away from the interior wall of the housing.

It is yet another object of the present invention to provide a plurality of contamination prevention shields juxtaposed between each spindle and conditioner arm and the housing wall for directing flow of cleaning solvent sprayed to remove slurry deposits on the components during a high pressure rinse.

It is still another further object of the present invention to provide a contamination prevention shield that is water resistent, lighweight, easily removable and does not easily shatter or crack.

SUMMARY OF THE INVENTION

In accordance with the present invention, an apparatus and method for preventing particle contamination in a polishing machine such as a chemical mechanical polishing apparatus are provided.

In a preferred embodiment, a contamination prevention apparatus for preventing contamination of a CMP apparatus is disclosed. The CMP apparatus is of the type having a conditioner arm and a housing having a planer wall having a top peripheral edge, an outer sidewall, an inner side wall, and a lower peripheral edge and wherein the planer wall further has an opening disposed. The contamination prevention apparatus further has:

(a) a contamination prevention shield having a cleaning cup, two vertical side shields, a front vertical shield, and a floor that cooperate to prevent leakage of fluid splattered during a high pressure rinse of the CMP apparatus and an interior portion of the housing; and (b) a high pressure rinse apparatus connected to the contamination prevention shield having a conduit further connected to a fluid flow source wherein the conduit has at least one nozzle disposed within for dispensing cleaning fluid during a high pressure rinse cycle.

The present invention is further directed to:

(a) a plurality of contamination prevention shields each having a cleaning cup, two vertical side shields, a front vertical shield, and a floor, wherein each contamination prevention shield is juxtaposed between the inner side wall and the CMP apparatus, and wherein each contamination prevention shields cooperate to prevent leakage of fluid splattered during a high pressure rinse of the CMP apparatus and an interior portion of the housing; and (b) a high pressure rinse apparatus connected to the contamination prevention shield having a conduit connected to a fluid flow source wherein the conduit has a plurality of spaced-apart nozzles disposed within for dispensing cleaning fluid during a high pressure rinse cycle. Additionally, a method of use for several embodiments of the present invention is disclosed herein.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENTS

Figure 1A:
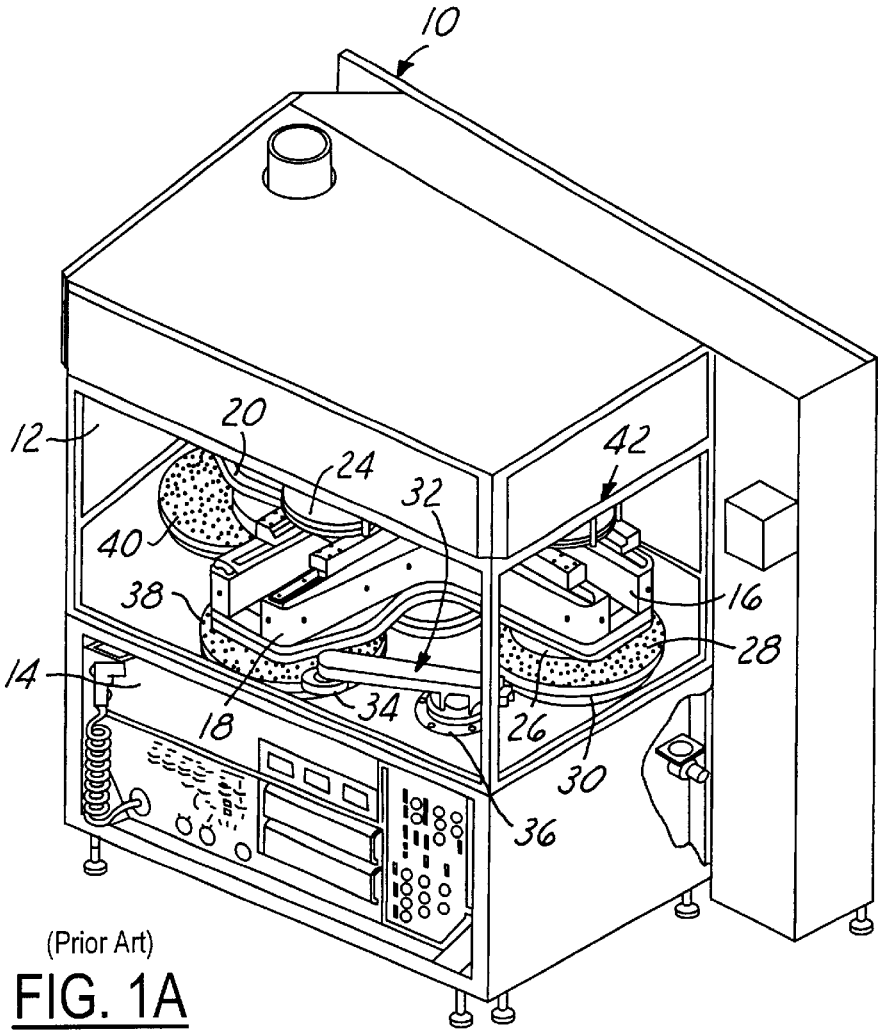
(Prior Art) FIG. 1A
FIG. 1A is a perspective view of a conventional chemical mechanical polishing apparatus illustrating three spindles and three polishing pads.
Figure 1B:
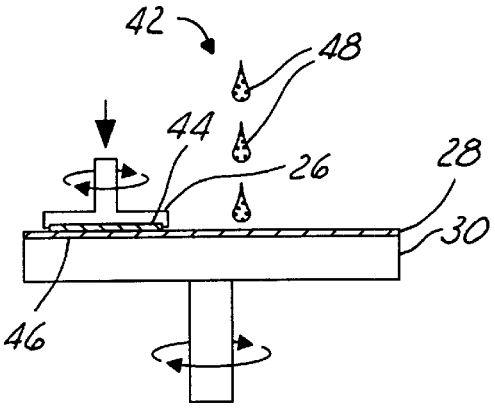
(Prior Art) FIG. 1B
FIG. 1B is a cross-sectional view of a polishing station wherein a wafer mounted in a polishing head is pressed against a polishing pad mounted on a polishing disc.
Figure 1C:
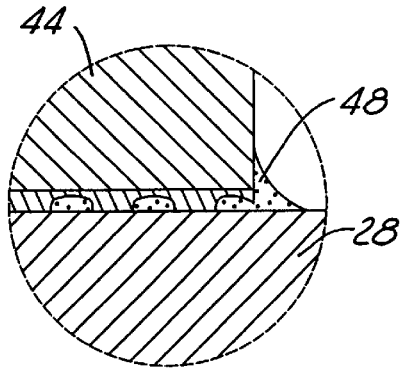
(Prior Art) FIG. 1C
FIG. 1C is an enlarged, cross-sectional view illustrating the interaction of a slurry composition with surfaces of a wafer and a polishing pad.
Figure 1D:
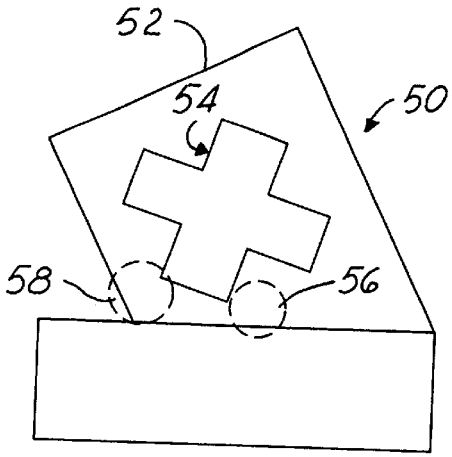
(Prior Art) FIG. 1D
FIG. 1D is a schematic of a conventional CMP illustrating the position of the spindle clean module.
Figure 1E:
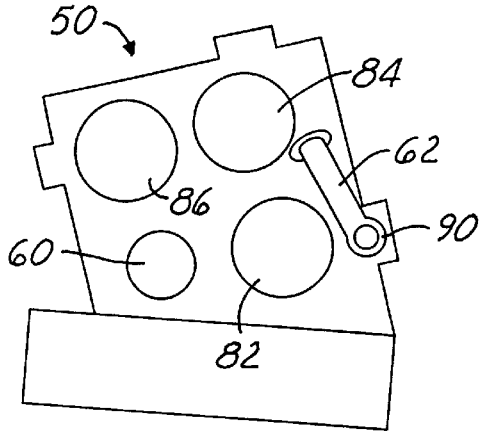
(Prior Art) FIG. 1E
FIG. 1E is a plan view of a conventional cleaning apparatus positioned in relation to a conditioner arm.
Figure 1F:
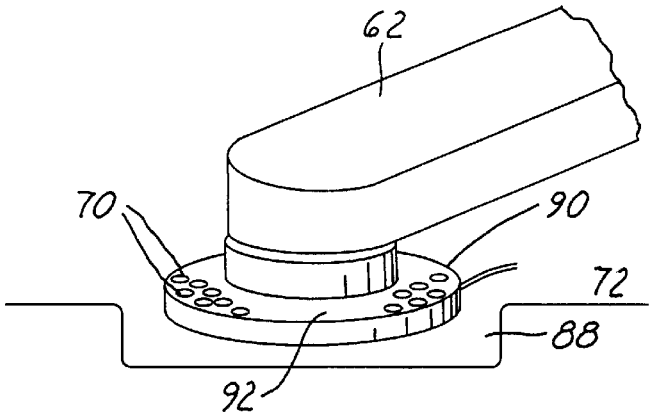
(Prior Art) FIG. 1F
FIG. 1F is a perspective view of a conventional cleaning apparatus positioned in relation to a conditioner arm and a conditioner clean cup.
Figure 1G:
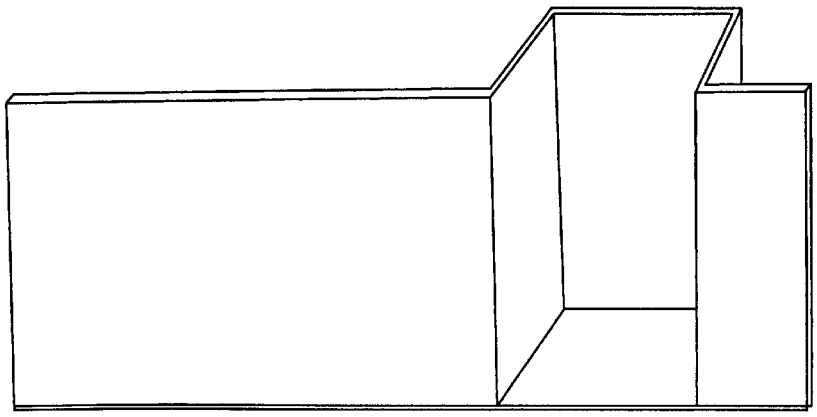
FIG. 1G is a perspective view of a conventional shield for protecting a conditioner arm and pad from slurry accumulation.

Referring now generally to the drawings 2–19, the present invention discloses a contamination prevention system having a contamination prevention shield that cooperates with a high pressure rinse apparatus to prevent contamination of particles within a CMP apparatus.

As shown in FIGS. 2–6, the contamination prevention system is further directed to a contamination prevention shield 98 and high pressure rinse apparatus 188 for preventing contamination of a CMP apparatus (not shown) having a housing (not shown). The contamination prevention shield 98 generally comprises a cleaning cup, two vertical side shields, a front vertical shield, and a floor that cooperate with a high pressure rinse apparatus 188 to prevent leakage of fluid splattered during a high pressure rinse to the CMP apparatus and an interior portion (not shown) of the housing. Preferably, the contamination prevention shield 98 is formed from a durable, water resistant but lightweight material such as acrylic that allows for easy removability of the shield and prevents against easy shattering or cracking. Additionally, it is preferable that the contamination prevention shield 98 be transparent to allow for a CMP operator or technician to easily recognize problems with the CMP apparatus during operation.

The CMP apparatus is of the conventional type used for polishing semiconductor wafers. The CMP has at least one spindle that cooperates with a polishing pad for processing a semiconductor wafer. Preferably, the CMP apparatus has at least three spindles each having an associated polishing pad for polishing a wafer and conditioner arm (not shown) for conditioning the polishing pad.

The housing has a planer wall 100 having a top peripheral edge 102, an outer side of wall 104, an inner side of wall 106,and a lower peripheral edge 108. The planer wall 100 further has an opening 110 disposed therethrough for mounting a cleaning cup described further below.

A cleaning cup 170 is integrally formed with the planer wall 100 of the housing and cooperates with the housing to prevent contamination of the conditioner arm and polishing pad. Preferably, the cleaning cup 170 is either cubular or rectangular in shape and protrudes outwardly from the opening 110 and away from the CMP apparatus and the interior portion of the housing.

Additionally, the contamination prevention shield 98 further has two vertical side shields 114, 134 having a uniform thickness. The side shields 114, 134 preferably are planer and are preferably rectangular in shape, each side shield 114, 134 having two long vertical sides 116, 118, 136, 138 respectively, and two parallel upper 120, 140 and lower horizontal sides 122, 142 respectively, each parallel side is shorter than the vertical sides 116, 118, 136, 138.

The long vertical sides 116, 136 respectively, sealingly engage the inner side 106 of the housing wall and extend upwardly from the lower peripheral edge 108 of the housing wall 100. The long vertical sides 116, 136 respectively, may be either integrally formed with the inner side 106 of the housing wall 100 or may be secured in a conventional manner to prevent contaminated cleaning fluid from flowing between the side 106 and the sides 116, 136 respectively. The lower horizontal sides 122, 142 respectively, are integrally formed with a floor of the contamination prevention shield 98 as described further below.

Additionally, the side shields 114, 134 have outer planer surfaces 124, 126, 144, 146 respectively (126, 144 not shown). The outer planer surfaces 126, 144 are in sealing engagement with an angular shield as described further below. Each outer planer surface 126, 144 preferably has an opening 128, 148 disposed therethrough for supporting a conduit 190 as described further below.

While the shields 114, 134 are preferably rectangular in shape, the side shields 114, 134 may be any other polygonal shape that does not deviate from the function as required to prevent contamination and provide support for an angular portion of the contamination prevention shield 98 and the conduit 190 in accordance with the present invention.

The contamination prevention shield 98 further has an angular shield 150 sealingly attached to the housing wall 100 that is further sealingly disposed between the two side shields 114, 134. The angular shield 150 may be attached to the housing wall 100 by integrally forming the angular shield 150 with the inner side 106 of the housing wall 100 or by attaching the angular shield 150 using any conventional means well-known in the plastic arts for sealingly attaching two surfaces to prevent fluid flow therebetween. Additionally, the angular shield 150 has two outer planer surfaces 160, 162. The outer planer surface 162 provides a smooth surface to direct contaminated cleaning fluid away from the inner side 106 of the housing wall 100 during a high pressure rinse of the CMP apparatus 94 and down a front shield portion of the contamination prevention shield 98 as described further below.

The angular shield 150 is planer having a uniform thickness and preferably, is rectangular in shape having two parallel long sides of equal length 152,respectively, and two parallel short sides of equal length 156, 158 respectively. Alternatively, the angular shield may be square in shape. The long side 152 sealingly engages the inner side 106 of the housing wall 100, and is disposed between the top peripheral edge 102 and the lower peripheral edge 108 of the housing wall 100. The long side 152 further extends inwardly towards the CMP apparatus and downwardly away from the inner side 106 of the housing wall 100. The short side 156 sealingly engages a vertical front shield as described further below.

The angular shield 150 is further disposed between each side shield 114, 134 respectively. The short sides 156, 158 of angular shield 150 are sealingly engaged with the outer planer surfaces 126, 144 of each side shield 114, 134 respectively, to prevent fluid flow therethrough.

Figure 6:
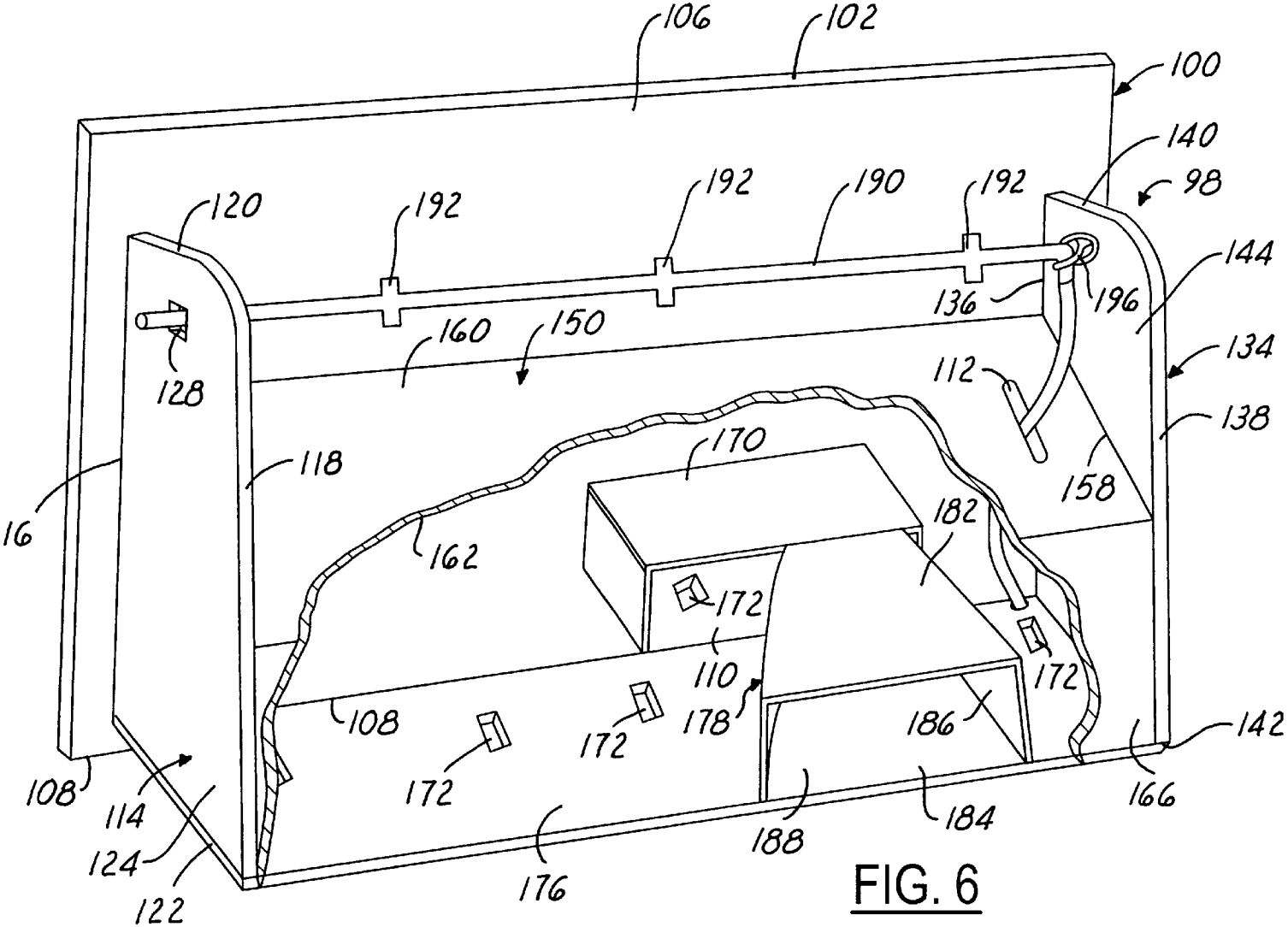
FIG. 6 is a perspective view of a contamination prevention system showing an alternative embodiment for mounting a conduit to a contamination prevention shield and a partial cut-away view of a cleaning cup, a conditioner arm shield, and a floor in accordance with the present invention.

As shown in FIG. 6, a slot 112 may be disposed in the angular shield 150 between the two outer planer surfaces 160, 162 for allowing a conduit to pass therethrough.

As shown in FIGS. 2–6, the contamination prevention shield 98 further has a vertical front shield 166 for further directing contaminated cleaning fluid away from the housing wall 100. The vertical front shield is planer and is parallel to the housing wall 100. The front shield 166 is sealingly engaged with the short side 156 of the angular shield 150 and is sealingly disposed between the outer surfaces 160, 162 between each side shield 114, 134 respectively. A peripheral edge of the front shield is sealingly engaged with the outer planer surfaces 126, 144 of each side shield 114, 134 respectively, to prevent fluid flow therethrough. A portion of the peripheral edge is fixedly mounted to a floor of the contamination prevention shield 98 described further below.

Figure 5:
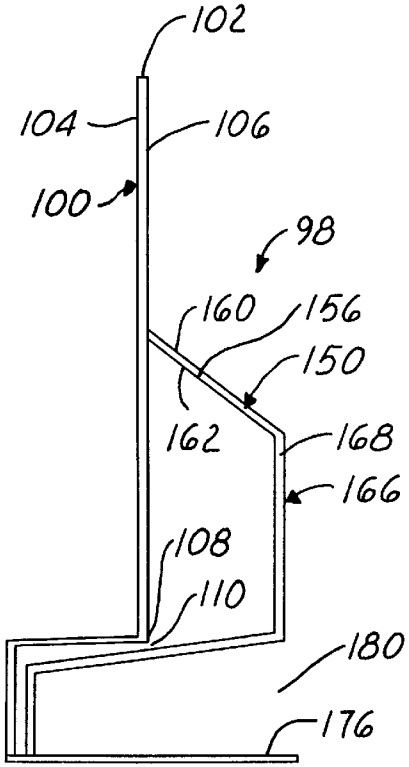
FIG. 5 is a simplified side view of the contamination prevention shield in accordance with the present invention.

As is shown further in FIGS. 3 and 5, the vertical front shield 166 further has an opening 180 therewithin in communication with a conditioner arm shield described further below.

As shown in FIGS. 2, 4–6, the contamination prevention shield 98 further has a floor 176 for directing fluid flow away from the housing wall 100 and the cleaning cup 170. The floor of the contamination prevention shield 98 has a portion complementary in shape to a lower perimeter of the cubular cleaning cup and extends at a sloping angle from an inside perimeter of the cubular cleaning cup to an inside perimeter of the housing wall 100 and then to an inside perimeter of both side shields and the vertical front shield 166. The floor 176 slopes at a slight angle away from the outer wall 100 downwardly towards the CMP apparatus 94 to direct flow of contaminated cleaning fluid away from the housing wall 100.

The floor 176 further comprises at least one drain aperture 172 disposed within the floor 176 for draining fluid from inside the housing of the CMP apparatus 94 to another location (not shown). Preferably, there is a plurality of drain apertures 172 that are spaced apart and are disposed within the floor 176 to allow for uniform drainage of fluid within the interior 97 of the housing 96.

Figure 2:
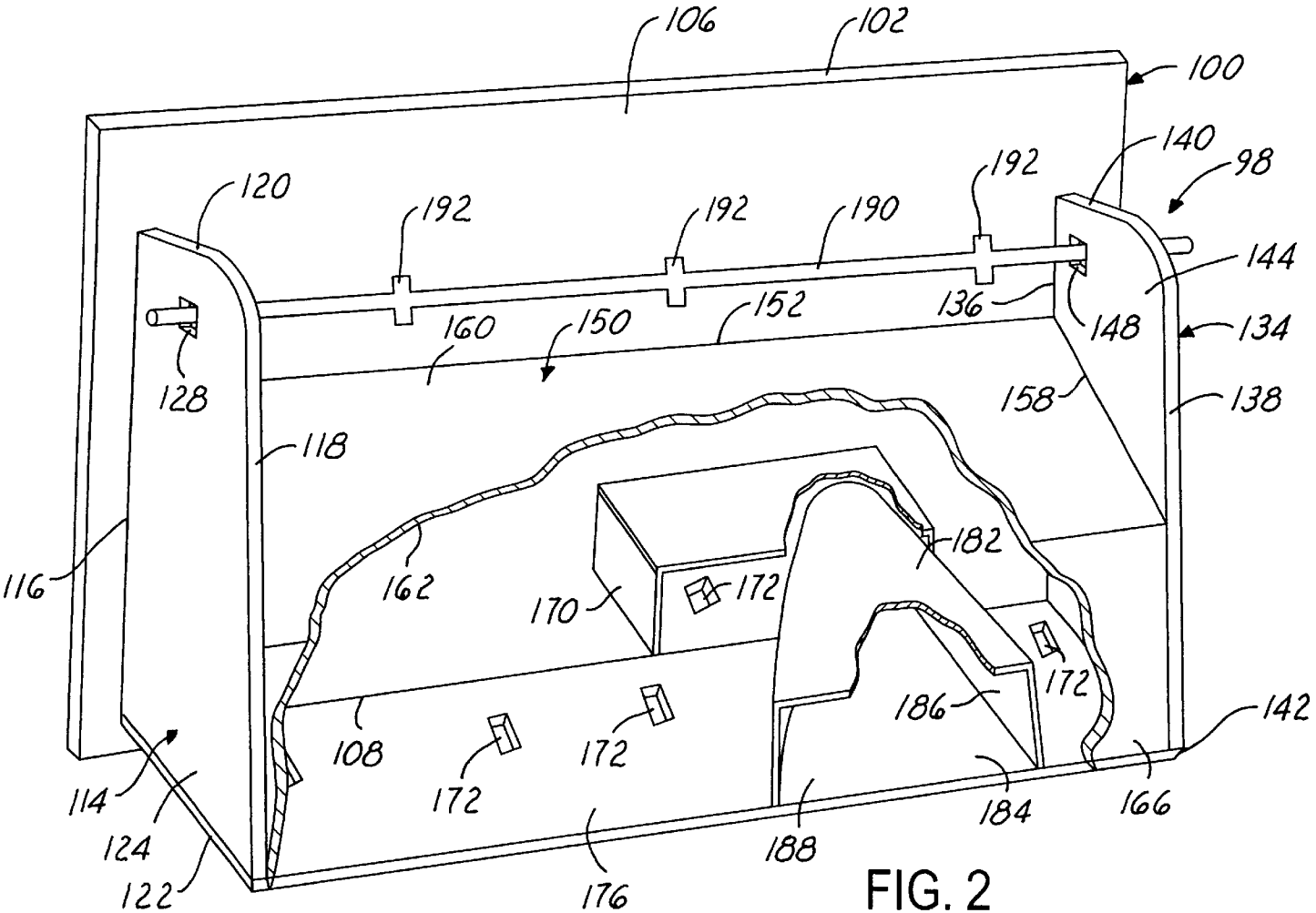
FIG. 2 is a perspective view of a contamination prevention system showing a partial cut-away view of a cleaning cup and conditioner arm shield in accordance with the present invention.
Figure 4:
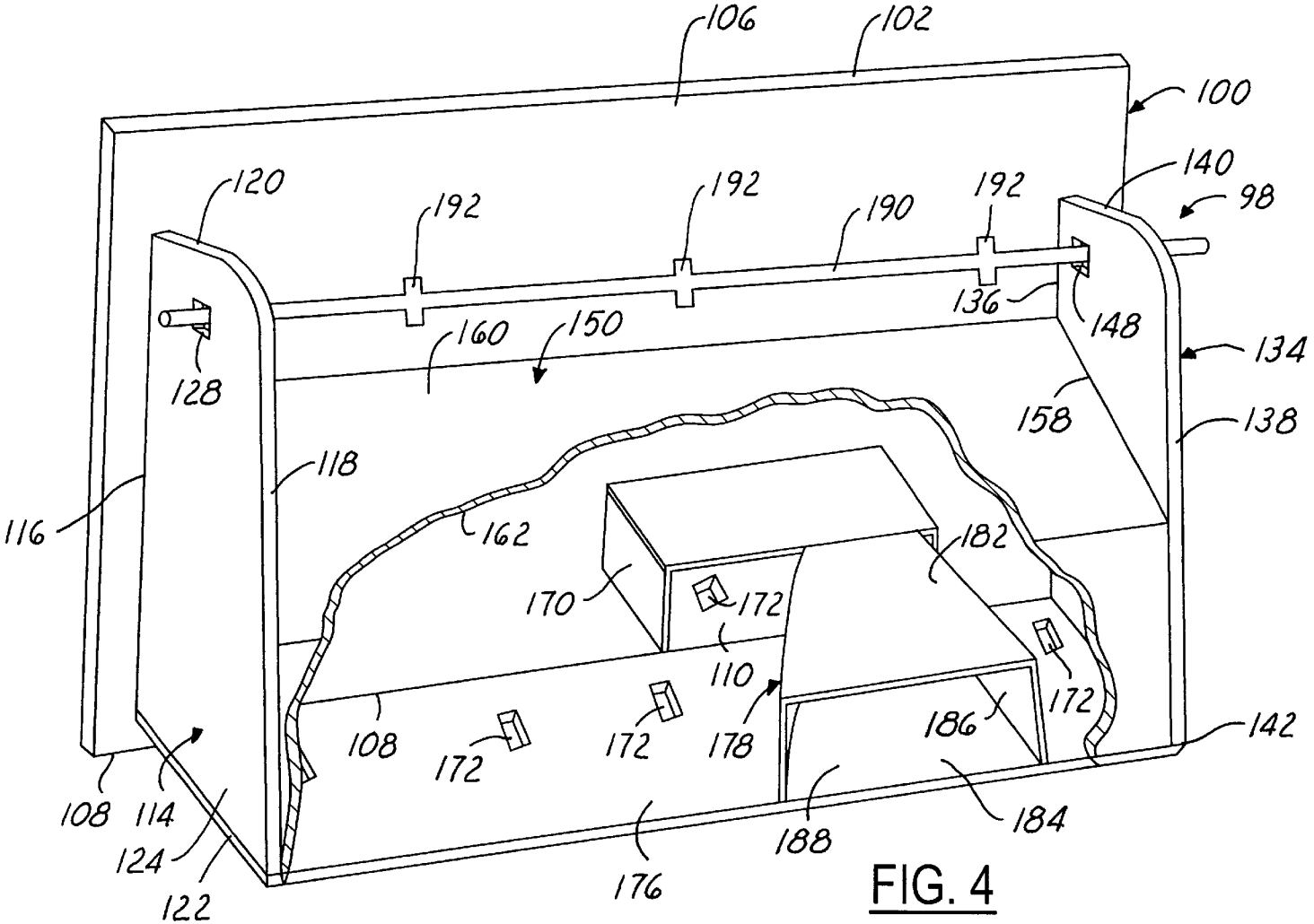
FIG. 4 is a perspective view of a contamination prevention system showing a partial cut-away view of a cleaning cup and conditioner arm shield and a floor in accordance with the present invention.
Figure 16:
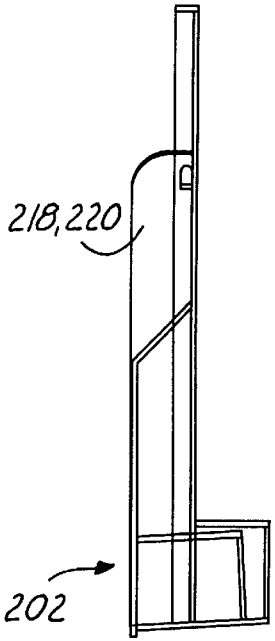
FIG. 16 is a side view of a contamination prevention shield in accordance with the present invention.
Figure 15:
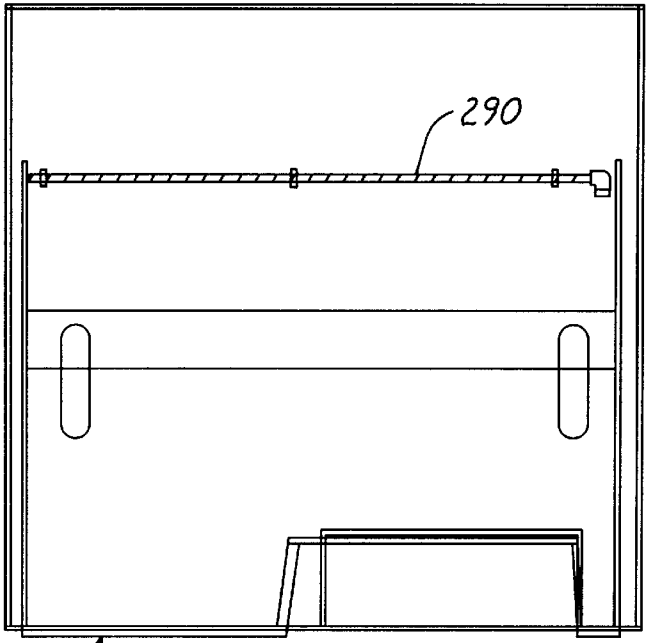
FIG. 15 is a front view of an alternative embodiment of a contamination prevention shield and a conduit in accordance with the present invention
Figure 14:
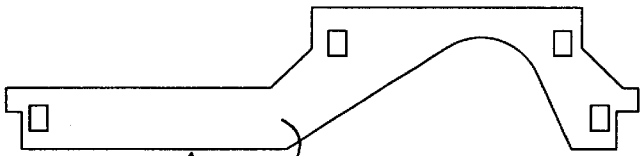
FIG. 14 is a top view of a floor of a contamination shield in accordance with the present invention.

As shown in FIGS. 2, 4, 6, the contamination prevention shield 98 further comprises a conditioning arm shield 178 partially houses within the cleaning cup 170 to further protect the conditioning arm and pad from further contamination.

As shown in FIGS. 2–4, 6, the conditioning arm and pad shield 178 is a three-sided shield having an upper surface 182, a lower surface 184 and a peripheral wall 186 partially disposed between the upper 182 and lower surface 184 and an open region interior region 189 in communication with the opening 180 of the vertical front side portion. The upper surface 182 is preferably, angled to direct fluid towards the floor 176 and thus, away from the interior 97 of the CMP housing 96.

The conditioning arm shield 178 is complementary in shape to the head portion of the conditioning arm and is preferably, parabolic in shape having a portion of the shield located inside the cleaning cup and a flat portion at the base of the parabola located flush with the vertical shield 166 such that an interior portion of the conditioning arm shield 178 is in communication with the opening 180 of the vertical front shield 166. Thus, the conditioning arm can easily be inserted into the interior portion and will be protected from a contaminated cleaning fluid such as slurry mixed with a cleaning solution that may splattered during the high pressure rinse and then later solidified into a dry fine powder.

The contamination prevention shield 98 cooperates with a high pressure rinse apparatus 188 that dispenses a cleaning fluid (not shown) such as deionized water to perform a high pressure rinse of the CMP apparatus 94 and interior of the CMP apparatus 94 housing. The high pressure rinse system 188 has a conduit 190 connected to a fluid flow source (not shown).

As is shown in FIGS. 2–4, 6, the conduit 190 has at least one nozzle 192 disposed within the conduit 190 for dispensing cleaning fluid during a high pressure rinse cycle. Preferably, there exists a plurality of equally spaced apart nozzles 192 for dispensing cleaning fluid at a rate of fluid flow of 30 nm per second to flush the CMP apparatus 94 and interior of the housing 97.

In a second preferred embodiment shown in FIG. 6, the conduit 190 is connected to a fluid source (not shown) through a connector located in the floor 176 of the prevention contamination shield 98. The conduit is then routed through the slot 112 in the angular shield 150 and is then mounted to the side shield 134. The side shield 134 may further comprise a conduit mounting bracket 196 for mounting the conduit 190 to the side shield 134. Additionally, the side shield 114 may further comprise a mounting bracket 198 (not shown) to support the conduit 190. The conduit is connected to both side shields 114 and in operation, circulates fluid therethrough and then dispenses the fluid through the at least one nozzle 192 or alternatively, a plurality of nozzles 192 during the high pressure rinse cycle to clean the CMP apparatus and the interior side 106 of the housing. The fluid then flows downwardly from the nozzle 192 to the angular shield 150 and then down the vertical front shield 166. Any contaminated cleaning fluid caught inside a region between the interior side 106, the side shield surfaces 126, 144 and the front shield will drain through the apertures 172 in the floor.

Figure 3:
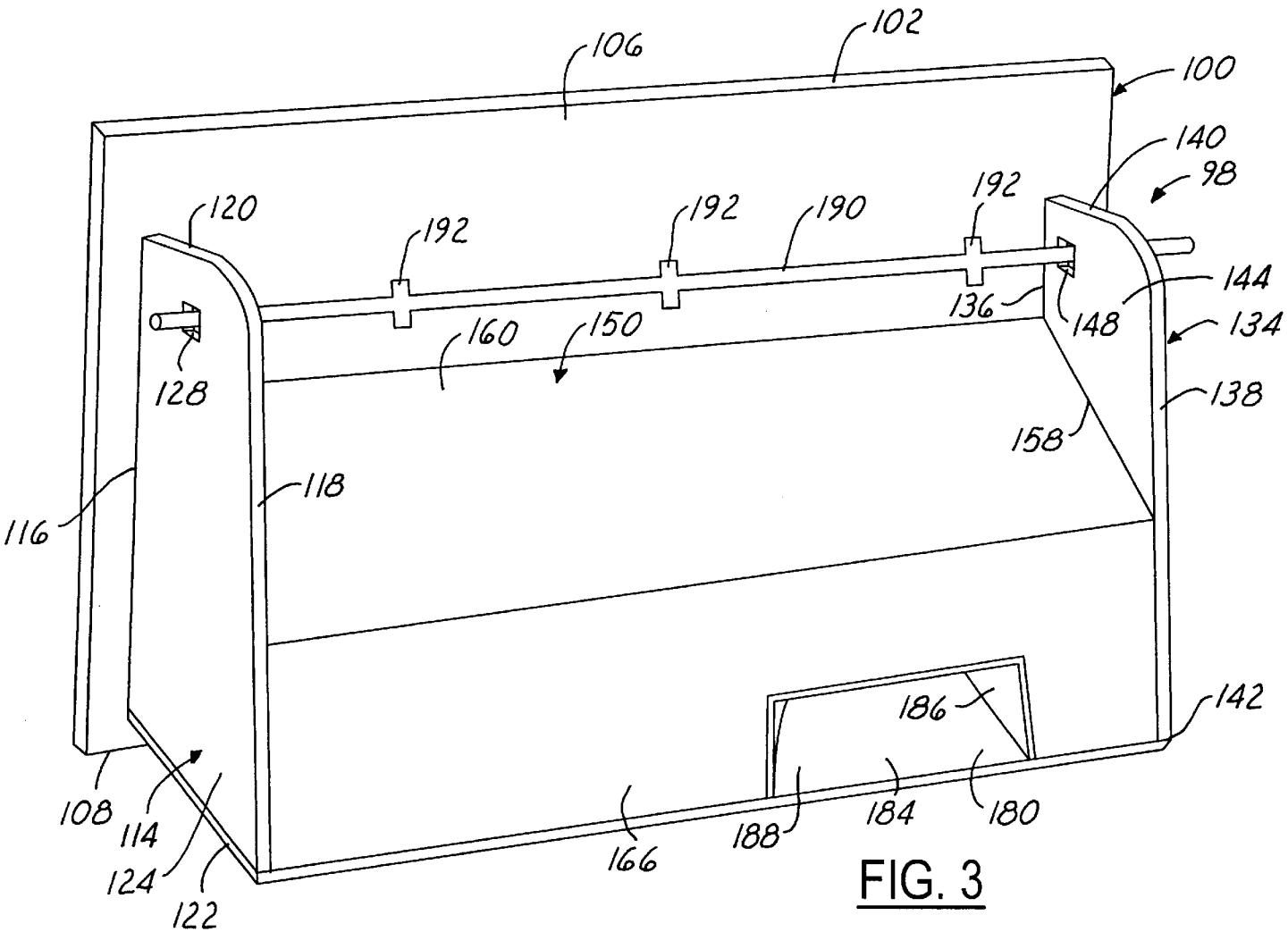
FIG. 3 is a perspective view of a contamination invention system showing an opening in a front shield in accordance with the present invention.

In a third embodiment shown in FIGS. 2–4, the conduit 190 may be connected to a fluid source (not shown) and then routed through the opening 148 of the side shield 134. The conduit 190 is then routed through the opening 128 and then mounted to the side shield 114. The conduit is disposed between both side shields 114 and in operation, circulates fluid therethrough and then dispenses the fluid through the at least one nozzle 192 or alternatively, a plurality of spaced-apart nozzles 192 during a high pressure rinse cycle to clean the CMP apparatus 94 and the interior wall 106 of the housing. The fluid then flows downwardly from the nozzle to the angular shield 150 and then down the vertical front shield. Any contaminated cleaning fluid caught inside a region between the interior side 106, the side shield surfaces 126, 144, and the front shield 166 will drain through the apertures 172 in the floor.

In a fourth embodiment shown in FIGS. 7–19, a plurality of shields 200, 202, 204 may cooperate to prevent contamination of a different portion of the inner side wall 106 and of the CMP apparatus 94 having a plurality of polishing pads and associated spindles. The shield 200 is similar to shield 98 as disclosed herein and is representative of each of the shields, however floors 206, 208 of shields 202, 204 vary slightly from a floor 210 of shield 200. Each shield 200, 202, 204 are juxtaposed in an angular position to each other to allow for the optimal placement of each shield 200, 202, 204 against a portion of the side wall 106.

Additionally, the shield 200 may have a side shield 212 similar to the side shield 134 as described in the first and third embodiment above, however an alternative side shield 214 having an opening 216 disposed therethrough is used to route a conduit 290 having a plurality of nozzles 292, similar to conduit 190, through the side shield 210 and then through the adjacent side shield 212 of the shield 202. The conduit 190 then passes through the side shields 218, 220 of shield 202, and then through side shield 222 of shield 204. The conduit is then mounted to side shield 224 for dispensing of fluid therethrough. While shown is a plurality of three shields, alternative embodiments are not limited to only three shields, the number of shields is proportionate to the number of polishing pads as required by the CMP apparatus 94.

Figure 7:
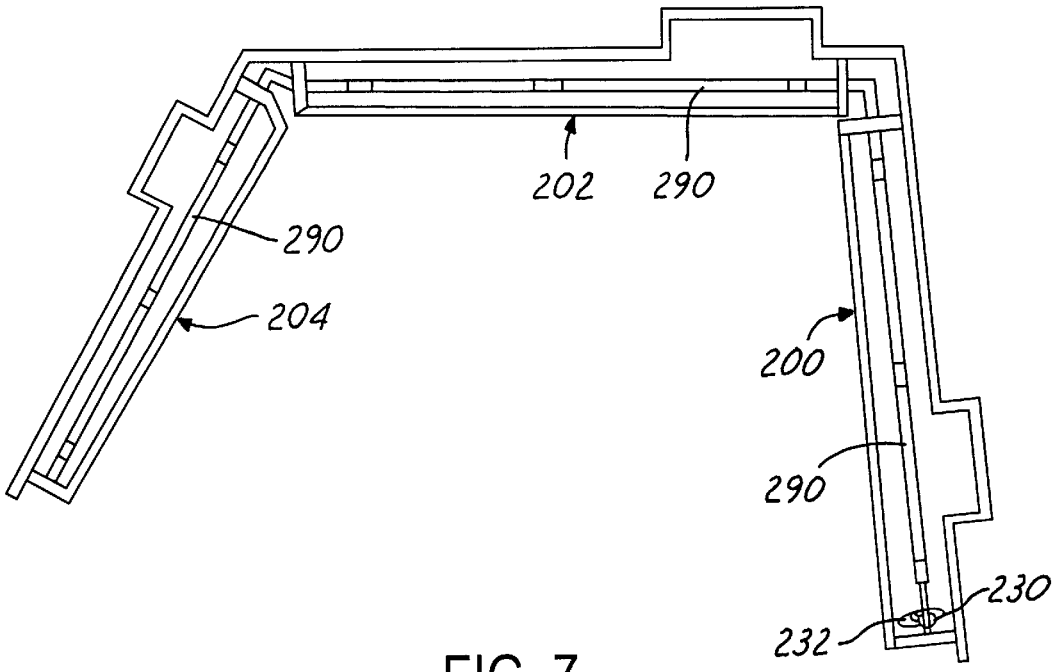
FIG. 7 is a simplified top view of a plurality of contamination prevention shields wherein one of the shields provides an alternative mounting means for a conduit in accordance with the present invention.
Figure 8:
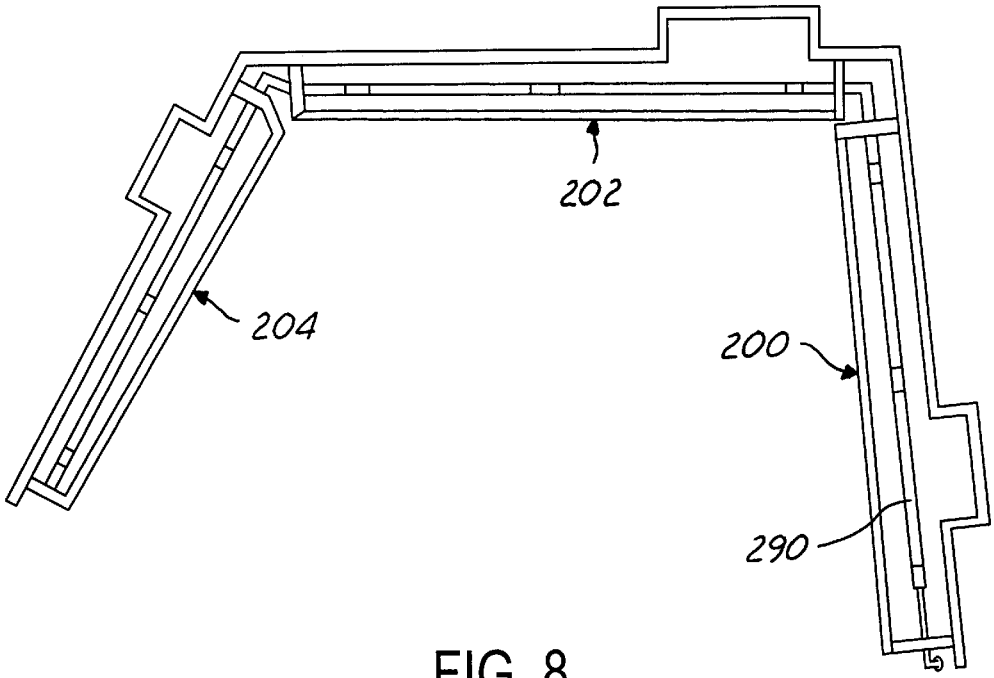
FIG. 8 is a simplified top view of a plurality of contamination prevention shields wherein a single conduit is routed therethrough for dispensing a cleaning solution during a high pressure rinse cycle in accordance with the present invention.
Figure 9:
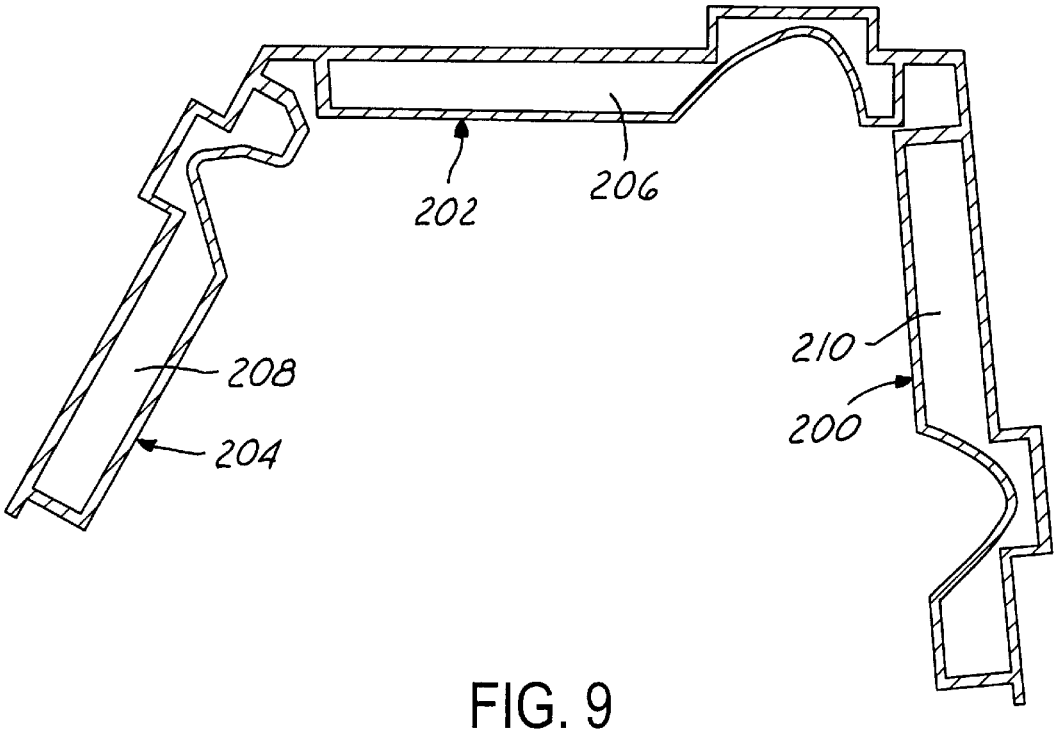
FIG. 9 is a cross-sectional view of plurality of contamination prevention shields each having an associated floor in accordance with the present invention.
Figure 10:
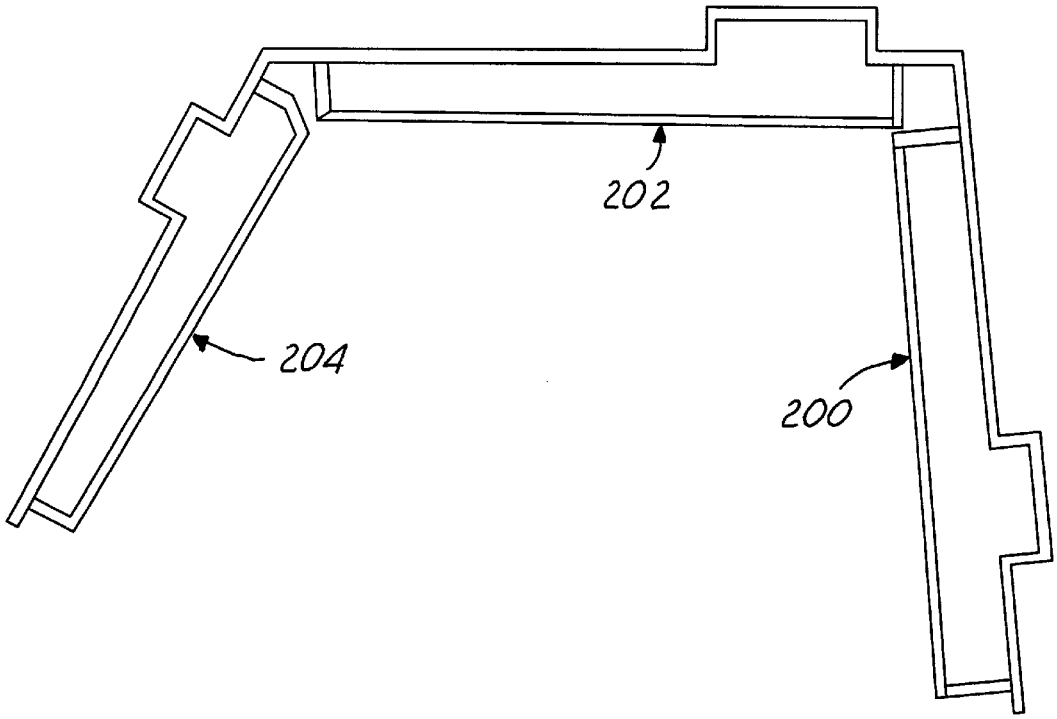
FIG. 10 is a simplified top view of a plurality of contamination prevention shields in accordance with the present invention.
Figure 13:
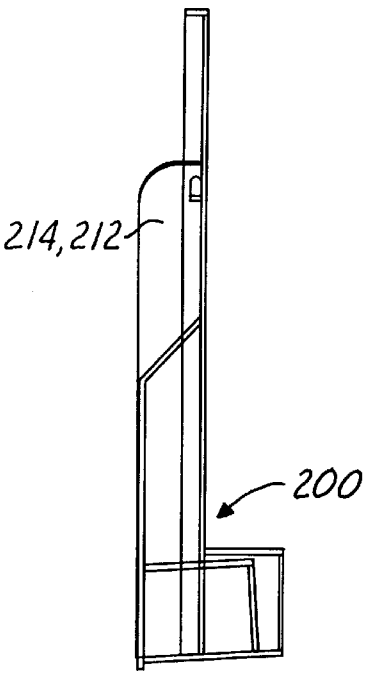
FIG. 13 is a side view of a contamination prevention shield in accordance with the present invention.
Figure 12:
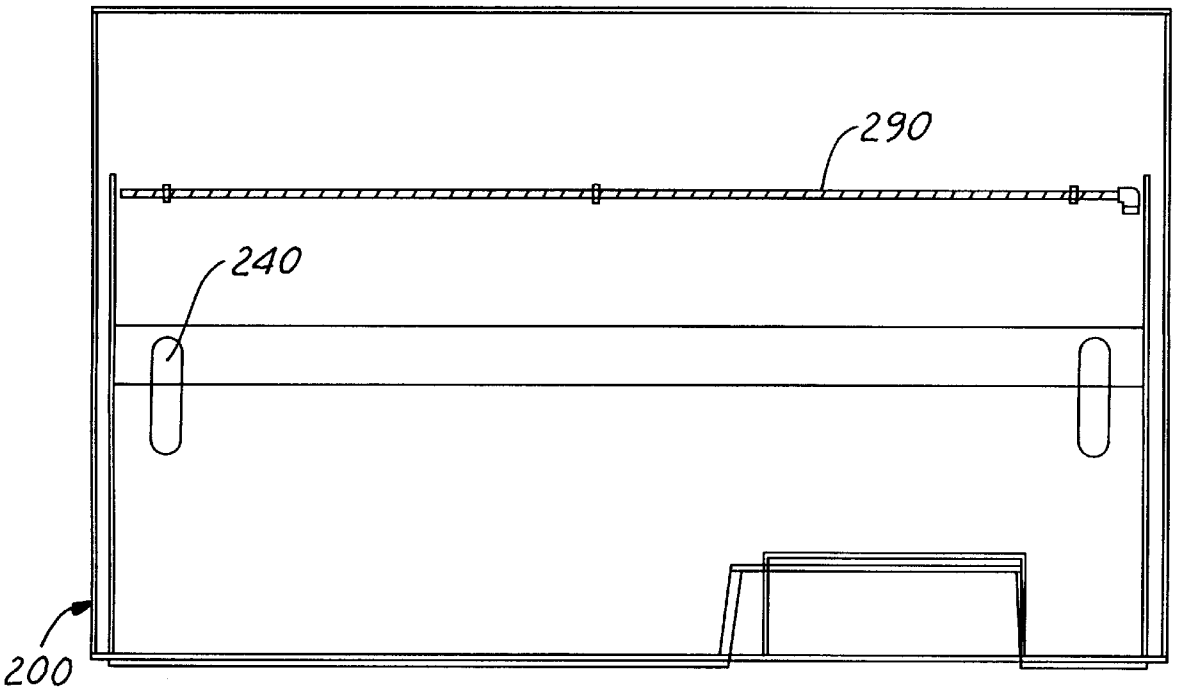
FIG. 12 is a front view of one embodiment of a contamination prevention shield and a conduit in accordance with the present invention.
Figure 11:
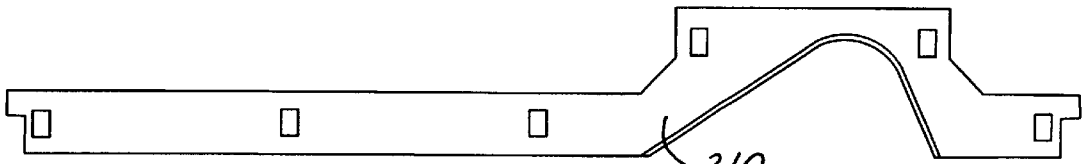
FIG. 11 is a top view of a floor of a contamination shield in accordance with the present invention.
Figure 19:
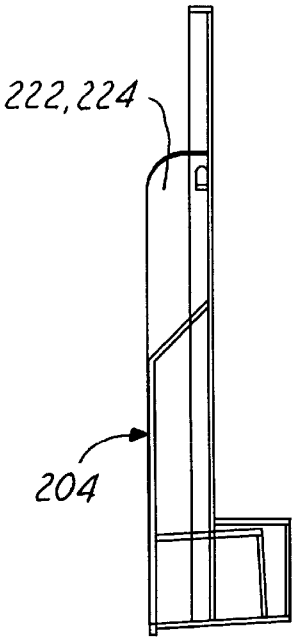
FIG. 19 is a side view of a contamination prevention shield in accordance with the present invention.
Figure 18:
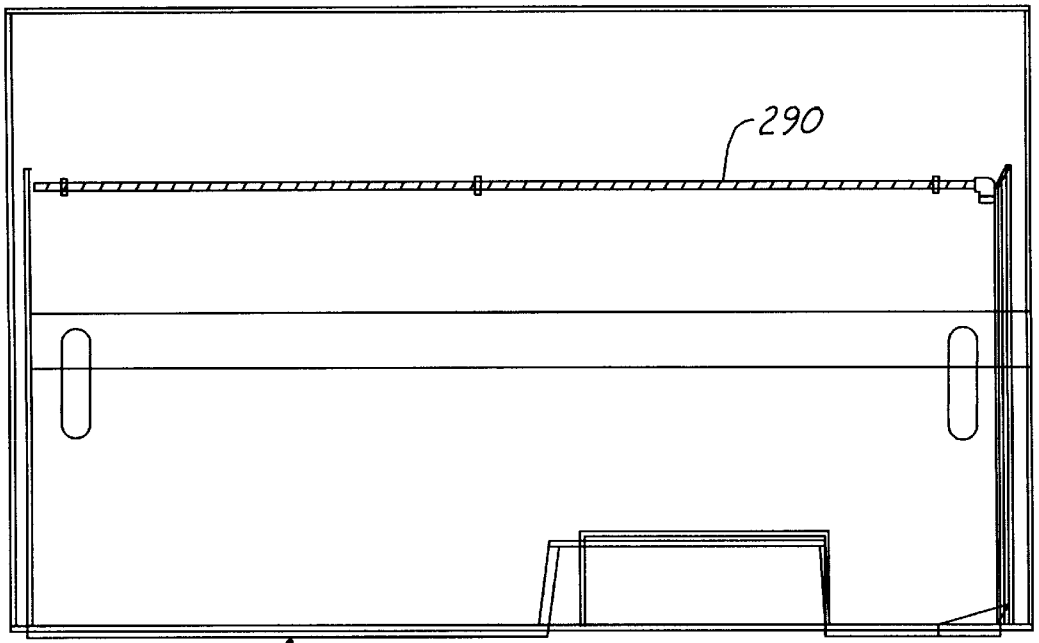
FIG. 18 is a front view of an alternative embodiment of a contamination prevention shield and a conduit in accordance with the present invention
Figure 17:
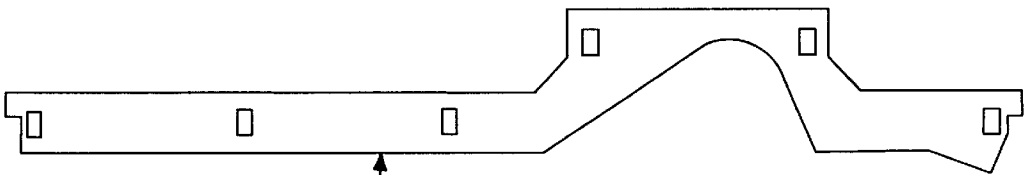
FIG. 17 is a top view of a floor of a contamination shield in accordance with the present invention.

As shown in FIG. 7, a mounting bracket 230 is used to secure the conduit 290 routed through a slot 232 in an angular shield 250. Alternatively, the conduit 290 could be routed from another location to an associated opening to the associated six side shields as shown in FIGS. 7–19.

What is claimed is:

1. A contamination prevention apparatus for preventing contamination of a CMP apparatus of the type having a conditioner arm and a polishing pad and a housing having a planer wall having a top peripheral edge, an outer sidewall, an inner side wall, and a lower peripheral edge and wherein the planer wall further has an opening disposed therethrough wherein the improvement comprises:

a contamination prevention shield having a cleaning cup, two vertical side shields, a front vertical shield, and a floor that cooperate to prevent leakage of fluid splattered during a high pressure rinse of the CMP apparatus and an interior portion of the housing; and a high pressure rinse apparatus connected to the contamination prevention shield having a conduit further connected to a fluid flow source wherein the conduit has at least one nozzle disposed within for dispensing cleaning fluid during a high pressure rinse cycle.

2. The contamination prevention apparatus of claim 1 wherein the cleaning cup is integrally formed with the planer wall of the housing and cooperates with the housing to prevent contamination of the conditioner arm and the polishing pad.

3. The contamination prevention apparatus of claim 2 wherein the cleaning cup is cubular in shape and protrudes outwardly from the opening in the planer wall and from the CMP apparatus.

4. The contamination prevention apparatus of claim 1 wherein the two vertical side shields are planer having a uniform thickness and wherein each vertical side shield further comprises:

an associated two vertical sides fixedly attached to the inner side of the planer housing wall to provide support to an angular shield and wherein one of the associated vertical side extends upwardly from the lower peripheral edge of the housing wall and is sealingly formed with the planer housing wall to prevent fluid from flowing therebetween;

an associated parallel upper and lower side integrally formed with the associated two vertical sides wherein the associated lower horizontal side is integrally formed with a floor of the contamination prevention shield to prevent flow of fluid therebetween; and an associated two outer planer surfaces wherein one of the associated outer planer surfaces attaches to an angular shield for directing fluid away from the planer housing wall.

5. The contamination prevention apparatus of claim 4 further comprising:

an opening disposed within the associated two outer planer surfaces of each side shield for supporting the conduit disposed there through.

6. The contamination prevention shield of claim 4 wherein the angular shield is in sealable engagement with the housing wall and is in further sealable engagement with the two side shields wherein the angular shield is juxtaposed between the housing wall and the two side shields and extends inwardly and downwardly from the inner side of housing wall to prevent fluid flow therebetween and wherein the angular shield further comprises:

an outer planer surface that provides a smooth surface to direct contaminated cleaning fluid away from the inner side of the housing wall during a high pressure rinse of the CMP apparatus and to the front shield of the contamination prevention shield.

7. The contamination prevention shield of claim 6 wherein the angular shield further comprises:

a slot disposed therethrough for allowing the conduit to pass therethrough.

8. The contamination prevention shield of claim 4 wherein the vertical front shield is juxtaposed between the angular shield, the two side shields and the floor, the vertical front shield further sealingly engages a peripheral edge of the angular shield and further sealingly engages an associated peripheral edge of each of the two side shields and wherein the vertical front shield further comprises:

an opening disposed therewithin, the opening in communication with a conditioner arm shield.

9. The contamination prevention apparatus of claim 1 wherein the contamination prevention shield is formed from acrylic.

10. The contamination prevention shield of claim 8 further comprises:

a conditioning arm and pad shield partially housed within the cleaning cup having three sides including an upper surface, a lower surface, and a peripheral wall disposed between the upper and the lower surface and an open interior region in communication with the opening of the vertical front side portion wherein the upper surface is angled to direct fluid towards the floor and thus, away from an interior portion of the CMP housing, and wherein the conditioning arm and pad shield is complementary in shape to a portion of the conditioning arm for easy insertion and protection of the arm portion therein.

11. The contamination prevention shield of claim 1 wherein the floor provides means for directing fluid flow away from the housing wall and the cleaning cup wherein the floor of the contamination prevention shield further comprises:

a portion complementary in shape to a lower perimeter of the cleaning cup, the floor is juxtaposed between the cleaning cup, the two side shields, the inner side of the housing, and the front vertical shield such that it extends at a sloping angle downwardly and inwardly towards the CMP apparatus from an inside perimeter of the cleaning cup to an inside perimeter of the inner side of the housing wall and then to an inside perimeter of both side shields and the vertical front shield to direct flow of contaminated cleaning fluid away from the housing wall; and at least one drain aperture disposed within for draining a fluid from inside the housing of the CMP apparatus to another location.

12. The contamination prevention shield of claim 11 further comprising:

a plurality of drain apertures that are spaced apart and are disposed within the floor for draining fluid from inside the housing of the CMP apparatus to another location.

13. A method of using the contamination prevention apparatus of claim 11 comprising the steps of:

dispensing cleaning fluid drawn from a fluid source through the conduit;

spraying fluid in a high pressure manner through the at least one nozzle disposed within the conduit;

allowing the sprayed fluid to flow downwardly from the inner side of the housing wall to the angular shield and then downwardly along an outer surface of the vertical front shield; and capturing all sprayed fluid in the at least one aperture in the floor of the contamination prevention shield.

14. The method according to claim 13 further comprising the step of:

spraying fluid in a high pressure manner through a plurality of nozzles disposed within the conduit.

15. The contamination prevention shield of claim 1 wherein the conduit further comprises:

a plurality of equally spaced apart nozzles for dispensing cleaning fluid at a rate of fluid flow of 30 nm per second to flush the CMP apparatus and the inner side of the housing wall; and wherein, the conduit is mounted to and disposed between the two side shields.

16. A contamination prevention apparatus for preventing contamination of a CMP apparatus of the type having a plurality of conditioner arms and associated polishing pads and a housing having a planer wall having a top peripheral edge, an outer sidewall, an inner side wall, and a lower peripheral edge and wherein the planer wall further has an opening disposed therethrough wherein the improvement comprises:

a plurality of contamination prevention shields each having a cleaning cup, two vertical side shields, a front vertical shield, and a floor, wherein each contamination prevention shield is juxtaposed between the inner side wall and the CMP apparatus and each contamination prevention shields cooperate to prevent leakage of fluid splattered during a high pressure rinse of the CMP apparatus and an interior portion of the housing; and a high pressure rinse apparatus connected to the contamination prevention shield having a conduit connected to a fluid flow source wherein the conduit has a plurality of spaced-apart nozzles disposed within for dispensing cleaning fluid during a high pressure rinse cycle.

17. The contamination prevention apparatus of claim 16 wherein the number of contamination prevention shields is proportionate to the number of conditioning arms and associated polishing pads.

18. The contamination prevention apparatus of claim 16 wherein the floor of each contamination prevention shield is juxtaposed in an angular position to each other to allow for the optimal placement of each shield against a portion of the side wall.

19. A method of using the contamination prevention apparatus of claim 16 comprising the steps of:

forcing cleaning fluid drawn from a fluid source to flow through the conduit;

spraying fluid in a high pressure manner through the plurality of nozzles disposed within the conduit;

allowing the sprayed fluid to flow downwardly from the inner side of the housing wall to the angular shield and then downwardly along an outer surface of the vertical front shield; and capturing all sprayed fluid in the apertures in the floor of each associated shield.

* * * * *